US007036547B1

(12) United States Patent
Cheng et al.

(10) Patent No.: US 7,036,547 B1
(45) Date of Patent: May 2, 2006

(54) HEIGHT ADJUSTABLE PLEATED SHADE

(75) Inventors: Li-Ming Cheng, Kaohsiung (TW); Lawrence S. Wu, Rowland Heights, CA (US)

(73) Assignee: ZipShade Industrial (B.V.I.) Corp., Ontario, CA (US)

( * ) Notice: Subject to any disclaimer, the term of this patent is extended or adjusted under 35 U.S.C. 154(b) by 121 days.

(21) Appl. No.: 10/651,573

(22) Filed: Sep. 2, 2003

(51) Int. Cl.
*A47H 5/00* (2006.01)

(52) U.S. Cl. ..... 160/84.04; 160/84.01; 160/171 R

(58) Field of Classification Search ..... 160/84.04, 160/84.01, 84.02, 84.06, 107, 168.1, 170, 160/171 R
See application file for complete search history.

(56) References Cited

U.S. PATENT DOCUMENTS 1,514,182 A * 11/1924 Stec ..... 160/292
2,110,145 A * 3/1938 Loehr ..... 160/89
2,116,237 A * 5/1938 Ehlers ..... 160/244
2,170,938 A * 8/1939 Carreras et al. ..... 160/178.1 R
2,253,519 A * 8/1941 Hicks ..... 160/399
2,311,348 A * 2/1943 Peters et al. ..... 160/239
2,315,033 A * 3/1943 Adair ..... 160/39
2,323,239 A * 6/1943 Renton ..... 160/104
2,579,144 A * 12/1951 Griesser ..... 160/70
5,482,100 A 1/1996 Kuhar
5,531,257 A 7/1996 Kuhar
5,813,447 A 9/1998 Lysyj
6,012,506 A 1/2000 Wang et al.
6,047,759 A 4/2000 Lysyj
6,056,036 A 5/2000 Todd et al.
6,289,965 B1 9/2001 Ruggles
6,293,329 B1 9/2001 Toti
6,330,899 B1 12/2001 Ciuca et al.
6,474,394 B1 11/2002 Kuhar

* cited by examiner

*Primary Examiner*—Bruce A. Lev
(74) *Attorney, Agent, or Firm*—William W. Haefliger

(57) ABSTRACT

An assembly including a shade capable of height adjustment, comprising shade including multiple pleats, a roller, one strap that extends through multiple pleats of the assembly, and the at least one strap operatively connected with the roller to be rolled on the roller as the height of the shade is reduced, and to be un-rolled as the height of the shade is increased.

13 Claims, 4 Drawing Sheets

HEIGHT ADJUSTABLE PLEATED SHADE

BACKGROUND OF THE INVENTION

This invention relates generally to easily adjustable window shades, and more particularly window shades employing pleated construction.

There is need for improvements in the construction and operation of pleated window shades enabling ease and reliability of adjustment, and also characterized by simplicity and durability. Prior shades of which we are aware lacked the unusual advantages in construction, operation and results now provided by the present shade.

SUMMARY OF THE INVENTION

It is a major object of the invention to provide an improved window shade enabling a pleated shade to adjust by roll-up operation. Basically, the shade assembly, capable of height adjustment, comprises:

a) a pleated shade construction capable of expansion and contraction of the pleats during height adjustment, b) a roller, c) at least one strap that extends through multiple pleats of said assembly, d) the strap or straps operatively connected with the roller to be rolled on the roller as the height of the shade is reduced, and to be un-rolled as the height of the shade is increased.

As will be seen, at least two such straps may be provided, and they are typically spaced apart, widthwise of the assembly, for load balance as during shade height adjustment and strap winding on, and unwinding off the roller as the roller rotates. The straps are typically narrow in width, to minimize frictional engagement with pleats through which the straps extend.

Another object includes provision of a spring within the roller and configured to be increasingly tensioned as the shade height is increased, and decreasingly tensioned as the shade height is reduced.

A further object is to provide an elongated enclosure within which the roller is located and supported in spaced relation to an end portion of the enclosure, said end portion being capable of cut-off to reduce the length of the enclosure to a selected length.

In this regard, the roller may advantageously be located and supported in spaced relation from opposite end portions of the enclosure, each end portion configured for selective length cut-off to size the overall length of the enclosure while maintaining the spaced straps in generally centered relation to the widthwise overall dimension of the shade.

An additional object is to provide a carrier or carriers within the enclosure to support the roller for rotation within the enclosure. The enclosure itself may preferably have a non-circular cross section in planes normal to the enclosure length dimension, the carrier or carriers fitting that non-circular configuration, to stably support the roller.

A yet further object is to provide an elongated base member at the lower end of said assembly, said at least one strap connected to the base member. Such structure enables ease of vertical height adjustment of the shade, by manual grasping of the base member for load transfer to the straps, avoiding adjustment load transfer to the pleats.

Another object is to provide a method of shade assembly sizing, that includes spacing the roller from one or both opposite end portions of the enclosure, and severing one or both end portions to reduce the overall length of the enclosure to selected length, while maintaining the roller positioned within the enclosure to be rotated for rolling and unrolling said at least one strap.

These and other objects and advantages of the invention, as well as the details of an illustrative embodiment, will be more fully understood from the following specification and drawings, in which:

DRAWING DESCRIPTION

DETAILED DESCRIPTION

Figure 1:
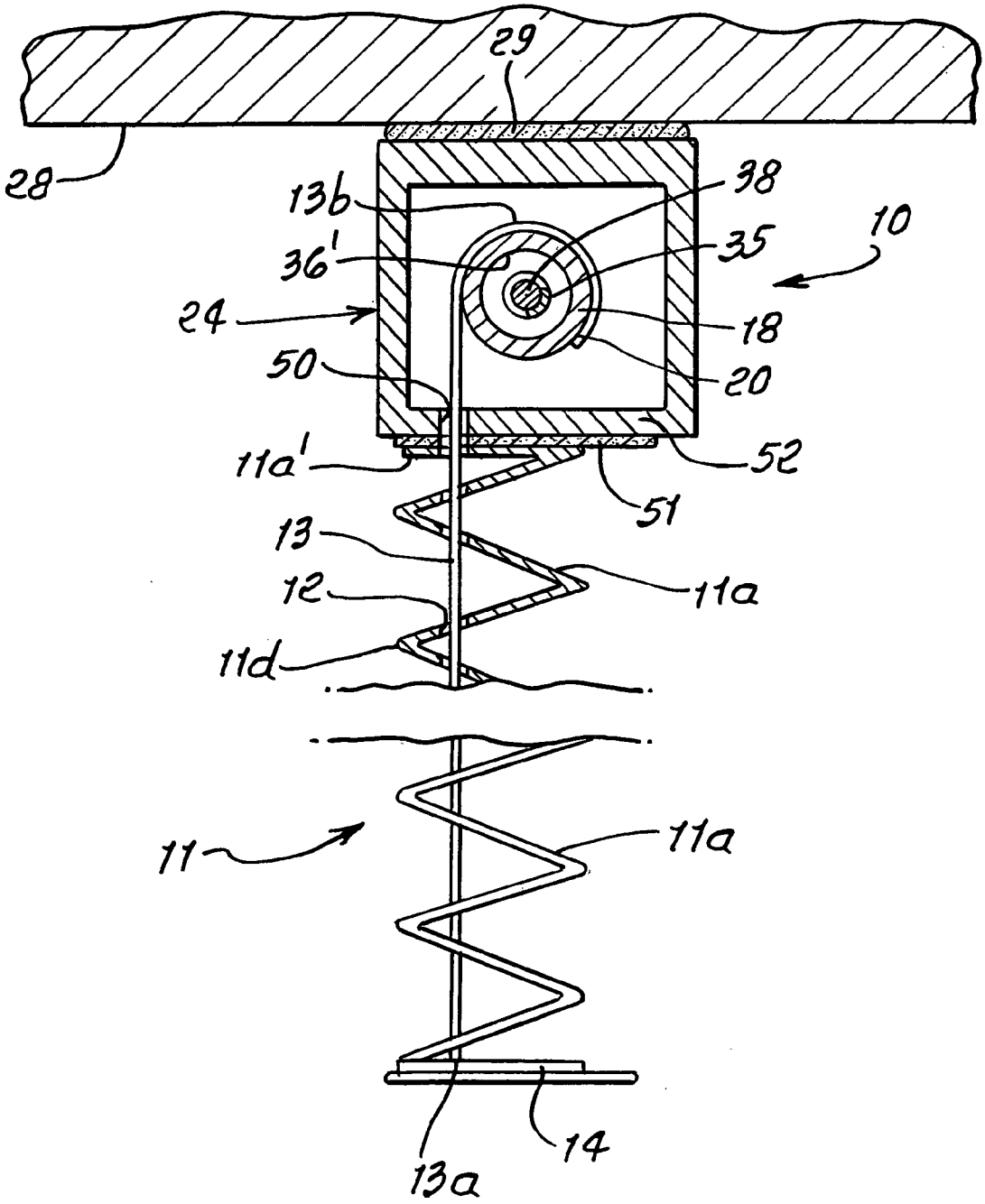
FIG. 1 is an enlarged end view of a pleated shade, shade support strap, strap roller, and enclosure.

Referring first to FIG. 1, it shows an assembly 10 including a pleated shade 11 having zig-zag pleats 11*a*, with vertically aligned through openings 12 to pass a strap 13. The pleats are flexibly connected at 11*d*. The lower end of the strap is connected at 13*a* to a transversely extending base slat or bottom rail 14, which is easily graspable to adjust the shade up or down. See these elements in FIG. 2, which shows two such straps 13 that are transversely spaced apart, to provide balanced support for the pleated shade 11 as it is height adjusted up or down in response to manipulation of the base slat.

Figure 2:
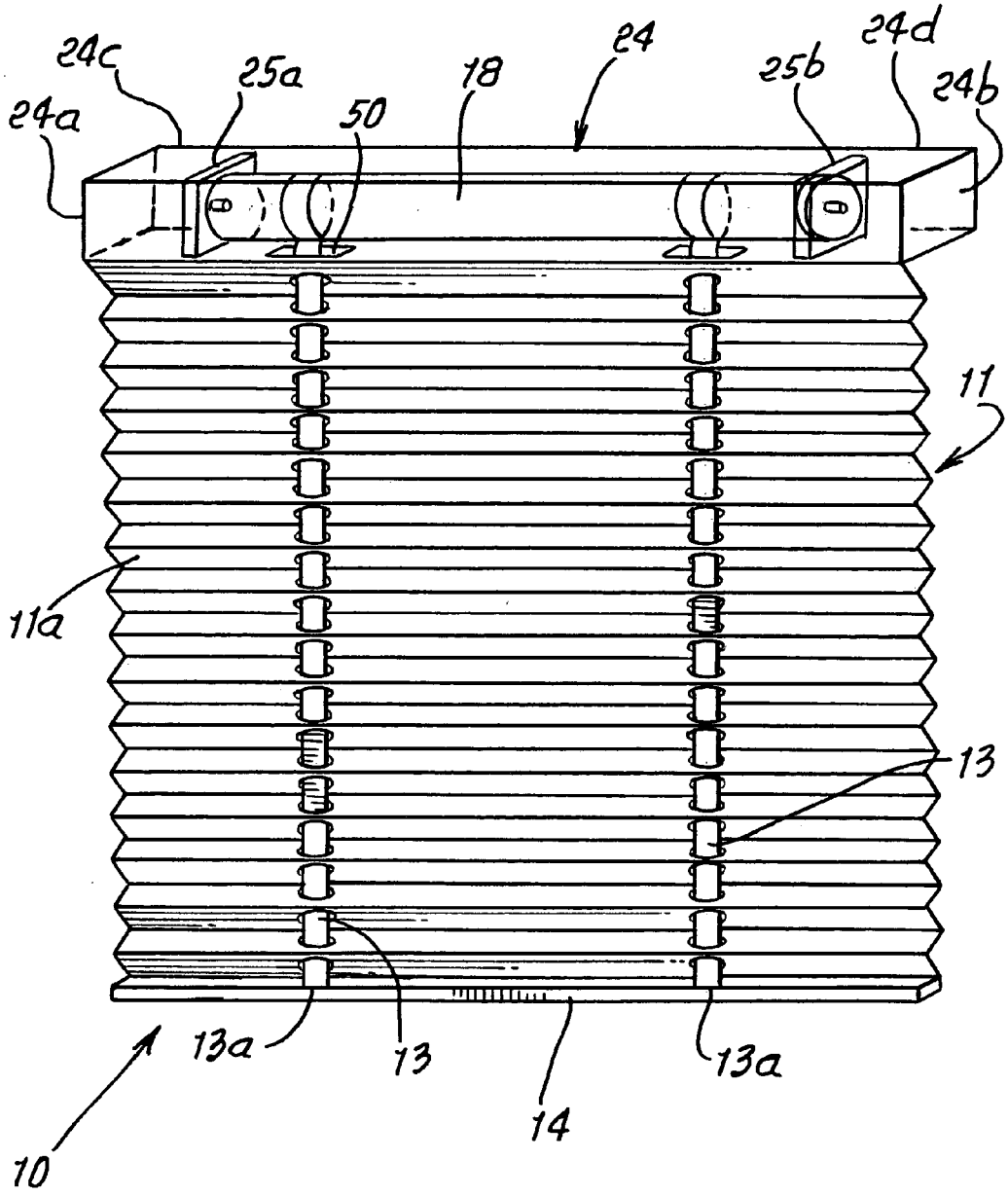
FIG. 2 is a perspective view of a pleated shade, two shade support straps, a strap roller; an enclosure for the roller, and schematically shown roller supports in the enclosure.

The assembly 10 also includes a roller 18 that extends transversely to wind strap 13 in FIG. 1, and to wind both straps 13 in FIG. 2. The strap or straps are operatively connected with the roller to be rolled on the roller as the height of the shade is reduced, and to be un-rolled as the height of the shade is increased. See for example strap connection to the roller periphery, at 20 in FIG. 1. The strap or straps are relatively narrow, to minimize frictional engagement with the pleats along the strap width, and at their vertical edges. For this purpose, the straps may typically have widths between ½ and 2 inches. They may consist of flexible, rollable, plastic material, and have thickness less than about 1/16 inch. The pleats 11*a* of the shade 11 may also consist of plastic material. Strap windings on the roller are indicated at 13*b*.

Figure 3:
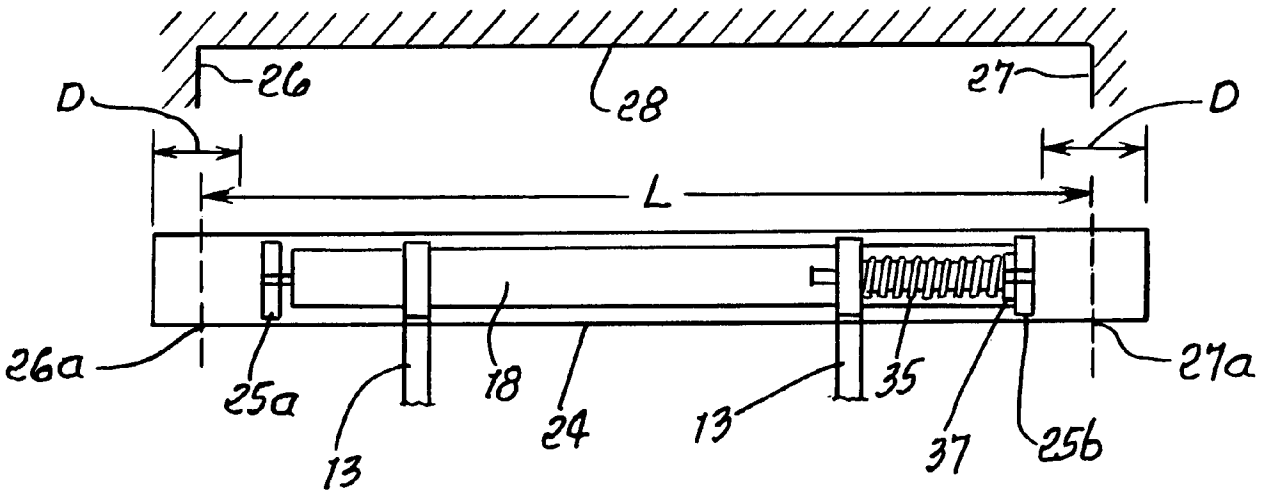
FIG. 3 is an enlarged schematic view of a roller with shade support straps wound on the roller, and roller supports in an enclosure, and a shade tensioning spring.

Also provided is a transversely elongated enclosure or head rail 24, within which the roller is located and supported in spaced relation to opposite ends 24*a* and 24*b* of the enclosure, or end portions thereof. Roller end carriers are provided at 25*a* and 25*b*, spaced from end enclosure ends 24*a* and 24*b*. Enclosure extents between 24*a* and 25*a*, and between 24*b* and 25*b* are indicated at 24*c* and 24*d*, in FIG. 2. The enclosure is selectively cuttable at extents 24*c* and 24*d* to enable close fitting of the enclosure remainder between window frame vertical members 26 and 27, as indicated in FIG. 3. For that purpose, the enclosure end extents may be cut or severed at locations 26*a* and 27*a*, as indicated. This does not interfere with roller or strap operation, since the roller and straps are located between and spaced from cut end locations 26*a* and 27*a*. Note also that the straps may, as a result, be positioned at equal distances from opposite ends of the enclosure length L remaining after such severing. Dimensions seen at D may be about 4 inches. An enclosure bottom opening or openings 50 pass the strap or straps. The uppermost pleat 11*a*' is attached at 51 to the enclosure bottom wall 52.

The top of the enclosure may easily be attached to the underside of window frame transverse member 28. This may be accomplished by providing tape 29 with adhesive at its opposite sides, to adhere to the top of the enclosure, and also to the underside of the member 28. See FIG. 1.

Figure 5:
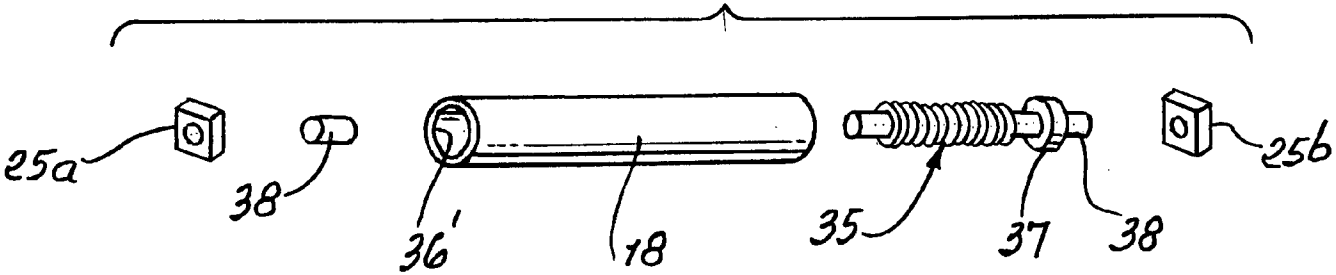
FIG. 5 is an exploded schematic view of a spring and shaft assembly.
Figure 4:
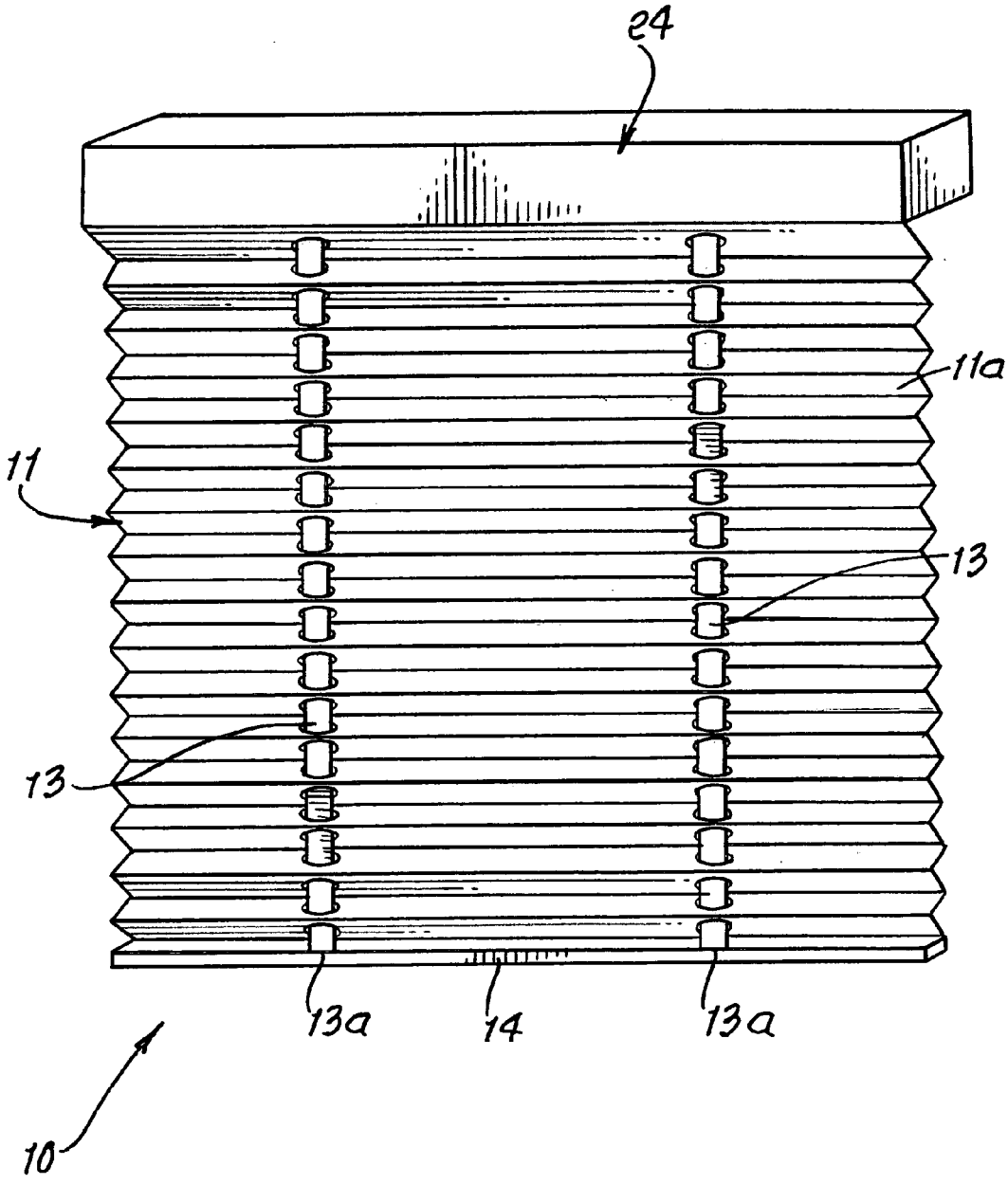
FIG. 4 is a perspective view of a pleated shade and roller enclosure, as viewed from the front of the shade.

Roller tensioning means is provided acting to urge the roller in a winding direction; and a releasable clutch holds the roller in a rotated position corresponding to selected shade height. One example is a tension spring 35 located within a roller bore 36', the spring having one end 35*a* attached to a mounting pin 36 that is retained by carrier 25*a*; the opposite end of the spring is retained by a clutch 37 within a roller bore 36' and having a mounting pin 38 retained by carrier 25*b*. The clutch is releasable when momentary rotary force is exerted on the roller via a downward urging of the slat 14, and straps 13, to allow shade height adjustment. When up or down movement of the slat 14 is arrested, the clutch engages to hold the roller against further rotation. See also FIG. 5.

Additional advantages and features include:

1. Provision of a cordless pleated shade, which may be used as a temporary shade.
2. Provision of a spring rolling assembly to actuate straps that pass through shade pleats.
3. Typical materials of construction:
   Head rail 24—Square cardboard head rail with double sided adhesive tape at the rail top;
   Bottom rail 14—Hollow PVC bottom rail;
   Shade pleat 11*a* material—Polypropylene (P.P.);
   Structural strap 13—4 cm (about 1½") wide polypropylene (P.P.) strap.
4. Use of concealed spring roller assembly to operate the lowering and raising of the pleated shade, so that corrugated pleats gather as strap rolling takes place.
5. Thin structural straps 13 used instead of cords, minimizing the space build-up when the structural straps are completely rolled to raise the shade up to the top position.
6. Structural straps, wider than cords, also add to extraordinary durable appearance of the product.
7. Hollow PVC bottom rail 14 may be fabricated for easy and comfortable manual gripping during operation of the shade.
8. Double sided adhesive tape may be used on top of head rail for easy installation, i.e. attachment to a horizontal window frame member.
9. Cardboard head rail, polypropylene material, and hollow PVC bottom rail are all easily cut by a utility knife, to fit any size window.
10. Cordless window covering is considered to be a completely child safe.

The invention as shown in FIGS. 1–4 is preferred, and supports the method steps that include:

$x_1$) providing an elongated headrail in the form of an enclosure consisting of lightweight cuttable material and within which the roller is located and supported in spaced relation from opposite end portions of the enclosure, each of said end portions being capable of selective cut-off to reduce the length of the enclosure to selected length, while locating said one or more straps at substantially equal distances from opposite ends of the enclosure which remain after cut-off, $X_2$) providing fixed position block-shaped carriers within the enclosure and spaced from opposite ends of the enclosure to support the roller for rotation while fixed in endwise position within the enclosure, and relative to said carriers, the carriers provided to be more rigid than the enclosure to provide structural integrity to the assembly, allowing end portions of the enclosure to be cut for sizing.

What is claimed is:

1. The method of providing an assembly including a shade capable of height adjustment, comprising:

a) providing said shade including multiple pleats, b) providing a roller, and c) providing at least one strap that extends through multiple pleats of said assembly, d) said at least one strap operatively connected with the roller to be rolled on the roller as the height of the shade is reduced, and to be un-rolled as the height of the shade is increased, e) providing an elongated head rail in the form of an enclosure consisting of lightweight cuttable material and within which the roller is located and supported in spaced relation from opposite end portions of the enclosure, each of said end portions being capable of selective cut-off to reduce the length of the enclosure to selected length, while locating said one or more straps at substantially equal distances from opposite ends of the enclosure which remain after cut-off, f) providing fixed position block-shaped carriers within the enclosure and spaced from opposite ends of the enclosure to support the roller for rotation while fixed in endwise position within the enclosure, and relative to said carriers, the carriers provided to be more rigid than the enclosure to provide structural integrity to the assembly, allowing end portions of the enclosure to be cut for sizing.

2. The method of claim 1 wherein at least two of said straps are provided to be spaced apart, and which extend in generally parallel relation.

3. The method of claim 2 wherein said straps are provided to have widths between ½ inch and 2 inches.

4. The method of claim 1 including providing a spring within the roller and configured to be increasingly tensioned as the shade height is increased, and decreasingly tensioned as the shade height is reduced.

5. The method of claim 1 including providing means on the enclosure to attach it to a window frame.

6. The method of claim 1 wherein the enclosure is provided to have non-circular cross sections in planes normal to the enclosure length dimension.

7. The method of claim 6 wherein said non-circular cross sections are provided to be substantially rectangular.

8. The method of claim 1 including providing an elongated base member at the lower end of said assembly, said at least one strap connected to said base member.

9. The combination of claim 1 wherein the enclosure consists of lightweight, cuttable material.

10. The combination of claim 9 wherein said material consists of cardboard.

11. The method of claim 1 wherein the enclosure is provided to have an opening to pass the strap, in vertical alignment with openings defined by the pleats.

12. The method of claim 1 wherein the enclosure is provided to have bottom openings to pass the straps in vertical alignment with openings defined by the pleats.

13. The method of claim 1 including severing said end portions to reduce the overall length of the enclosure to selected length, while maintaining the roller positioned within the enclosure to be rotated for rolling and unrolling said at least one strap.

* * * * *